US007185471B2

(12) United States Patent
Schmerber

(10) Patent No.: US 7,185,471 B2
(45) Date of Patent: Mar. 6, 2007

(54) METHOD FOR MAKING A WOODEN BEAM, WOODEN BEAM AND STRUCTURE FOR CONSTRUCTING A BUILDING

(75) Inventor: Claude Schmerber, Saint-Bernard (FR)

(73) Assignee: Dorean Sarl, Saint-Bernard (FR)

( * ) Notice: Subject to any disclaimer, the term of this patent is extended or adjusted under 35 U.S.C. 154(b) by 271 days.

(21) Appl. No.: 10/415,883

(22) PCT Filed: Nov. 12, 2001

(86) PCT No.: PCT/FR01/03518

§ 371 (c)(1),
(2), (4) Date: May 8, 2003

(87) PCT Pub. No.: WO02/40802

PCT Pub. Date: May 23, 2002

(65) Prior Publication Data

US 2004/0074195 A1 Apr. 22, 2004

(30) Foreign Application Priority Data

Nov. 14, 2000 (FR) ..... 00 14611

(51) Int. Cl.
*E04B 1/32* (2006.01)
*E04B 7/08* (2006.01)

(52) U.S. Cl. ..... 52/642; 52/653.1; 52/693; 156/331.7

(58) Field of Classification Search ..... 52/93.1, 52/90.1, 639, 653.1, 690, 693, 642, 741.1, 52/695, 692; 156/311, 292, 295, 331.7
See application file for complete search history.

(56) References Cited

U.S. PATENT DOCUMENTS

| | | | | | |
|---|---|---|---|---|---|
| 3,008,195 | A | * | 11/1961 | Coffey | 52/93.2 |
| 3,748,809 | A | * | 7/1973 | Jackson | 52/644 |
| 3,813,842 | A | * | 6/1974 | Troutner | 52/693 |
| 4,001,999 | A | * | 1/1977 | Chandler | 52/693 |
| 4,159,606 | A | * | 7/1979 | Kindberg | 52/692 |

(Continued)

FOREIGN PATENT DOCUMENTS

| | | |
|---|---|---|
| FR | 2572759 | 5/1986 |

(Continued)

*Primary Examiner*—Naoko Slack
*Assistant Examiner*—Chi Q. Nguyen
(74) *Attorney, Agent, or Firm*—Greenblum & Bernstein, P.L.C.

(57) ABSTRACT

Method of manufacturing a wooden beam includes arranging first and second elongated members parallel to one another and at a predetermined distance from one another, arranging the at least two crosspieces on the first and second elongated members, arranging third and fourth elongated members respectively opposite the first and second elongated members and on the at least two crosspieces, gluing, with a flexible glue, contact zones, whereby the first elongated member, the second elongated member, the third elongated member, the fourth elongated member, and the at least two crosspieces form an assembly, and pressing the assembly in order to crush layers of the flexible glue, wherein elastic joints are formed in each assembly zone after the pressing and after the flexible glue are dry, and wherein the elastic joints allow for a relative movement. This Abstract is not intended to define the invention disclosed in the specification, nor intended to limit the scope of the invention in any way.

22 Claims, 4 Drawing Sheets

U.S. PATENT DOCUMENTS 4,285,176 A * 8/1981 Runkle ..... 52/93.1
4,317,316 A * 3/1982 Atwood et al. ..... 52/93.1
4,441,287 A * 4/1984 Muir ..... 52/93.2
4,677,806 A 7/1987 Tuomi
4,967,534 A * 11/1990 Lines ..... 52/729.4
5,341,611 A * 8/1994 Lewis ..... 52/90.1
5,354,411 A * 10/1994 Lines ..... 156/556
5,560,177 A * 10/1996 Brightwell ..... 52/729.4
5,911,177 A * 6/1999 Fox et al. ..... 108/15
6,139,667 A * 10/2000 Sanford et al. ..... 156/92
6,231,031 B1 * 5/2001 Michael et al. ..... 256/65.02

FOREIGN PATENT DOCUMENTS

FR 2754843 4/1998
GB 1603357 11/1981

* cited by examiner

METHOD FOR MAKING A WOODEN BEAM, WOODEN BEAM AND STRUCTURE FOR CONSTRUCTING A BUILDING

CROSS-REFERENCE TO RELATED APPLICATIONS

The present application is a National Stage Application of International Application No. PCT/FR01/03518, filed Nov. 12, 2001 and which published as WO 02/40802. Further, the present application claims priority under 35 U.S.C. § 119 of French Patent Application No. 00/14611 filed on Nov. 14, 2000.

BACKGROUND OF THE INVENTION

1. Field of the Invention

The present invention relates to:

a method for manufacturing a wooden beam constituted of basic elements defining its ridges and forming at least four elongated members connected by other basic elements forming at least two crosspieces, the elongated members and the crosspieces being assembled in assembly zones by the gluing of their contact zones, a wooden beam manufactured according to the aforementioned method, and a wooden frame for the construction of a building.

2. Discussion of Background Information

As known in the field of construction, and more particularly in that of wooden frame constructions, the wooden beams are unitary and carved from the block, or are made of wood core plywood, or constituted by the assembly of smaller basic elements. The unitary wooden or wood core plywood beams are heavy, cumbersome, difficult to handle, rigid, have a high ecological and economical cost, and tend to become fissured.

Wooden beams that are constituted of the assembly of smaller basic elements allow the lightening of the frames, the ease of assembly and the lowering of construction costs. The assembly of the basic elements together is obtained in a known and non-limiting manner by clamps, glued dowels, pins, screws or complementary glued nesting forms. The French Patent FR-A-2 572 759 describes a beam obtained by the assembly of four parallel square rulers connected together by crosspieces that are arranged at an angle in a herringbone pattern. The assembly is achieved by nesting and gluing complementary machined grooves in the square rulers and crosspieces, respectively. The object sought by this invention is to obtain rigid beams having a substantial length. It is also with this object that the square rulers are pre-stressed before their assembly and gluing, or that the square ruler lattice is doubled. The British Patent GB-A-1 603 357 describes a beam having the same construction but in which the crosspieces and square rulers are assembled by gluing plywood spacers inserted therebetween and allowing the stiffening of the assembly.

A major drawback to this type of assembly is that these various attachment systems create rigid connections between the basic component elements of the wooden beam, and do not allow any freedom of movement between these basic elements. The beam obtained no longer has any elasticity. Consequently, when it is subject to forces, these rigid connections create very substantial stresses in the assembly zones that weaken the basic elements involved, which can cause them to crack or even break. As a result, this technique does not allow the manufacture of wooden beams having a substantial span. Indeed, the bending due to the load applied on these wooden beams creates forces that are too substantial in the assembly zones, and leads to the breaking of the wooden beams. The manufacture of these types of wooden beams having a substantial span therefore necessarily requires the use of at least one intermediary bearing wall that makes it possible to reduce the stresses sustained by these wooden beams.

SUMMARY OF THE INVENTION

The present invention overcomes these drawbacks by proposing a method for manufacturing a wooden beam which is simple, economical, ecological, without machining or pre-stressing, allowing the beam to maintain its flexibility, particularly in its assembly zones, in order to distribute the stresses evenly throughout the beam, thus to increase the resistance of the frames obtained by the assembly of these beams, and to be able to obtain wooden beams having a substantial span without requiring an intermediary bearing wall.

An object of the invention is also to propose a wooden beam having good squaring and ensuring a good crossbracing as well as a good mechanical stability, particularly in case of earthquakes, due to the flexibility of its assembly zones.

Finally, the invention aims to propose a wooden frame for the construction of a building allowing the improvement of living comfort by eliminating the grating and the creaking noise of the wood, by limiting the fissures, and by increasing the flexibility of the floor, due to the flexibility of its assembly zones.

The invention relates to a manufacturing method as defined in the preamble, characterized in that it comprises the steps for setting a first elongated member and a second elongated member in parallel manner and at a predetermined distance, for setting at least two straight crosspieces on the two elongated members and for gluing their contact zones by way of a so-called flexible glue, for setting on said crosspieces a third elongated member and a fourth elongated member opposite the first elongated member and the second elongated member, respectively, and for gluing their contact zones by way of a so-called flexible glue, and for tightening the assembly thus obtained to crush the layers of glue to a predetermined thickness, these layers of glue being arranged to form, after crushing and drying, elastic joints in each assembly zone of said beam allowing a relative movement between the elongated members and the corresponding crosspieces.

According to an advantageous feature of the invention, the so-called flexible glue is marketed at trademark ADHEFLEX® T1. This glue is a polyurethane flexible glue.

According to another advantageous feature of the invention, a holding rod is positioned in the assembly zone.

According to another advantageous feature of the invention, the elongated members and crosspieces have an identical cross-section.

According to another advantageous feature of the invention, the crosspieces are positioned at regular intervals and according to a predetermined pattern, in order to form, with respect to the elongated members, an angle $\alpha$ other than 90°, for example, comprised between 20 and 40°, and preferably equal to 30°.

According to another advantageous feature, the crosspieces are positioned at an angle in a herringbone pattern.

The invention also relates to a wooden beam constituted of basic elements defining its ridges and forming at least four elongated members connected by other basic elements forming at least two crosspieces, characterized in that the elongated members and the crosspieces are assembled in assembly zones by the gluing of the contact zones according to the manufacturing method as defined previously.

In this embodiment, the glue used is a flexible glue arranged to form, after drying, elastic joints allowing a relative movement of the elongated members with respect to the crosspieces, and vice-versa. The elongated members and the crosspieces can have a cross-section selected from the group containing at least one square, one rectangle.

According to an advantageous feature of the invention, at least one of the assembly zones is at least partially traversed by a holding rod.

The invention also relates to a wooden frame for the construction of a building, characterized in that it is constituted of wooden beams as defined previously, which are assembled to form a frame section comprising, in particular, posts, tie beams and principal rafters. Several frame sections can be arranged to form a modular frame.

According to an advantageous feature of the invention, the wooden frame comprises wooden beams assembled by way of at least one assembly element selected from the group having at least one gusset, one cable, one screwed or nailed plate, and one spacer in recesses.

In another embodiment, the wooden frame comprises wooden beams arranged to receive service ducts, and/or supports for rolling shutter housings, mosquito nets and solar panels.

The invention also provides for a method of manufacturing a wooden beam comprising at least four elongated members connected by at least two crosspieces, said elongated members and said crosspieces being assembled to each other at assembly zones by gluing, wherein the method comprises arranging first and second elongated members parallel to one another and at a predetermined distance from one another, arranging the at least two crosspieces on the first and second elongated members, gluing, with a flexible glue, contact zones of the at least two crosspieces to contact zones of the first and second elongated members, arranging third and fourth elongated members respectively opposite the first and second elongated members and on the at least two crosspieces, gluing, with a flexible glue, contact zones of the at least two crosspieces and contact zones of the first and second elongated members to contact zones of the third and fourth elongated members, whereby the first elongated member, the second elongated member, the third elongated member, the fourth elongated member, and the at least two crosspieces form an assembly, and pressing the assembly in order to crush layers of the flexible glue to a predetermined thickness, wherein the elastic joints are formed in each assembly zone after the pressing and after the layers of flexible glue are dry, and wherein the elastic joints allow for a relative movement between the first, second, third, and fourth elongated members and the at least two crosspieces.

The flexible glue may comprise ADHEFLEX® T1. The method may further comprise at least one holding rod positioned in at least one of the assembly zones. The first, second, third, and fourth elongated members and the at least two crosspieces may have an identical cross-section. The at least two crosspieces may be positioned at regular intervals and according to a predetermined pattern. The at least two crosspieces may be oriented at an angle other than 90 degrees relative to the first, second, third and fourth elongated members. The angle may be between 20 degrees and 40 degrees. The angle may be 30 degrees. The at least two crosspieces may be arranged to form a herringbone pattern.

The invention also provides for a wooden beam made by the method described above. The first, second, third, and fourth elongated members and the at least two crosspieces may have one of a square-shaped cross-section and a rectangular-shaped cross-section. At least one of the assembly zones may be at least partially traversed by a holding rod.

The invention also provides for a wooden frame for use in building construction, wherein the wooden frame comprises a plurality of wooden beams as described above assembled to form at least one frame section. The at least one frame section may comprise at least one post, at least one tie beam, at least one principal rafter.

The invention also provides for a wooden frame for use in building construction, wherein the wooden frame comprising at least two wooden beams as described above assembled to one another via at least one assembly element to form at least one frame section. The at least one assembly element may comprise one of at least one gusset, at least one cable, at least one screwed plate, at least one nailed plate, and at least one spacer.

The invention also provides for a modular wooden frame for use in building construction, wherein the modular wooden frame comprises a plurality of wooden beams as described above assembled to one another to form a plurality of frame sections.

The invention also provides for a wooden frame for use in building construction, wherein the wooden frame comprising a plurality of wooden beams as described above assembled to one another via at least one assembly element to form at least one frame section, wherein the plurality of wooden beams are arranged to receive at least one of service ducts, supports for rolling shutter housings, mosquito nets, and solar panels.

The invention also provides for a method of manufacturing a wooden beam which comprises first and second elongated members arranged parallel to one another and spaced at a predetermined distance from one another, third and fourth elongated members arranged respectively opposite the first and second elongated members, and a plurality of crosspieces having one end area connected to the first and third elongated members and another end area connected to the second and fourth elongated members, wherein the method comprises arranging the first and second elongated members parallel to one another and spaced from one another by a predetermined distance, arranging the third and fourth elongated members respectively opposite the first and second elongated members, arranging the one end areas of the plurality of crosspieces between the first and third elongated members, arranging the other end areas of the plurality of crosspieces between the second and fourth elongated members, and forming elastic joints by applying a flexible glue to contact zones of the plurality of crosspieces, to contact zones of the first and second elongated members, and to contact zones of the third and fourth elongated members, wherein, after the flexible glue is dry, the elastic joints allow for a relative movement between the first, second, third, and fourth elongated members and the plurality of crosspieces.

The method may further comprise crushing layers of the flexible glue to a predetermined thickness.

The invention also provides for a method of manufacturing a wooden beam comprising first and second elongated members spaced at a predetermined distance from one another, third and fourth elongated members arranged respectively opposite the first and second elongated members, and a plurality of crosspieces having one end portion connected to the first and third elongated members and another end portion connected to the second and fourth elongated members, wherein the method comprises spacing the first and second elongated members apart from one another, arranging the third and fourth elongated members respectively opposite the first and second elongated members, applying a flexible glue to contact zones of the plurality of crosspieces, to contact zones of the first and second elongated members, and to contact zones of the third and fourth elongated members, and assembling the plurality of crosspieces, the first and second elongated members, and the third and fourth elongated members together to form the wooden beam, wherein, after the flexible glue is dry, elastic joints are formed in said contact zones and the elastic joints allow for a relative movement between the first, second, third, and fourth elongated members and the plurality of crosspieces.

The method may further comprise, before the flexible glue is dry, crushing layers of the flexible glue to a predetermined thickness.

BRIEF DESCRIPTION OF THE DRAWINGS

The present invention and its advantages will become more apparent in the following description of an example of embodiment, with reference to the attached drawings, in which.

DETAILED DESCRIPTION OF THE INVENTION

Figure 1:
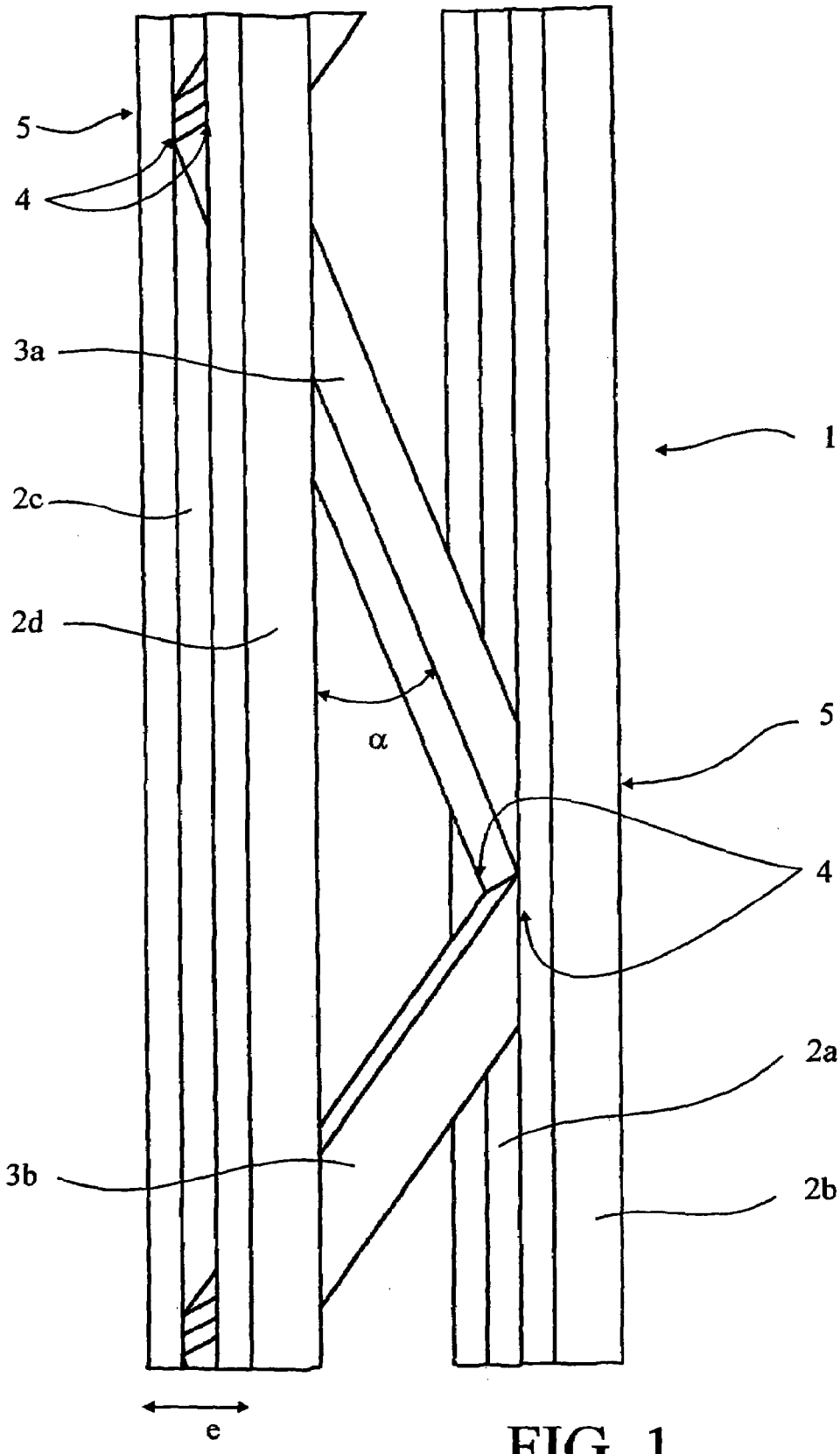
FIG. 1 is a perspective view of a wooden beam according to the invention.

In referring to FIG. 1, the wooden beam 1 has a cross-section that fits into a rectangle and comprises basic elements defining its ridges and forming four elongated members 2*a*, 2*b*, 2*c*, 2*d* connected by basic elements forming crosspieces 3*a*, 3*b* arranged at an angle in a herringbone pattern. The basic elements are assembled in assembly zones 5 by the gluing of their contact zones 4.

The elongated members 2*a*, 2*b*, 2*c*, 2*d* and the crosspieces 3*a*, 3*b* are basic elements made of straight wood. In order for them to be easily cut out in a standardized way, these basic elements preferably have an identical cross-section that is, for example, square or rectangular. A non-limiting example of sizes of a rectangular cross-section of a basic element is 70 mm by 30 mm. This standardizing of the cutouts makes it possible to simplify the production and to increase the output of the cutting machines. These basic elements can be used directly as untrimmed pieces from the sawmill or, if necessary, after planing to adjust their cross-section. They require no special machining nor any pre-stressing. The length of the elongated members 2*a*, 2*b*, 2*c*, 2*d* is selected depending on the length of the beam to be manufactured. Similarly, the length of the crosspieces 3*a*, 3*b* that, among other things, are used as spacers between the elongated members 2*a*, 2*b*, 2*c*, 2*d*, is selected depending on the width of the beam to be manufactured.

In order to limit the risk of fissures, or even to eliminate them completely, all of the basic elements are made out of wood, from a zone that does not pass through the heart of the trunk or the branch of the tree. Additionally, these basic elements have a relatively small cross-section that allows an in-depth treatment of fungicide and insecticide products that guarantee that they are of Class 2 and have a very long lifespan.

The elongated members 2*a*, 2*b*, 2*c*, 2*d* and the crosspieces 3*a*, 3*b* are assembled by gluing their contact zones 4. The gluing is done advantageously by way of a so-called flexible glue. In fact, this is a glue that, after drying, has the advantage of remaining flexible and forming an elastic joint that allows relative movements between the basic elements themselves and, consequently, that allows the wooden beam to remain flexible. A non-limiting example of so-called flexible glue is known as the trademark ADHEFLEX® T1, and comprises in particular a monocomponent polyurethane. Naturally, other glues can also be used as long as they have this indispensable property of flexibility. The use of a so-called flexible glue allows a better distribution of the stresses in the assembly zones and therefore an increase in the mechanical stability of these assembly zones. The flexibility of the wooden beam is improved, which imparts to it a better resistance to mechanical stresses, particularly during earthquakes. When the beam, and particularly a very long beam, is subject to substantial flexional forces, it undergoes an elastic deformation. The traction and compression forces are distributed through the wood fibers that can be deformed due to their own elasticity and due to the elasticity of the glue joints. As a result, this beam can achieve mechanical performances that are much greater than conventional massive beams, allowing it to attain spans exceeding 8 meters.

Figure 4:
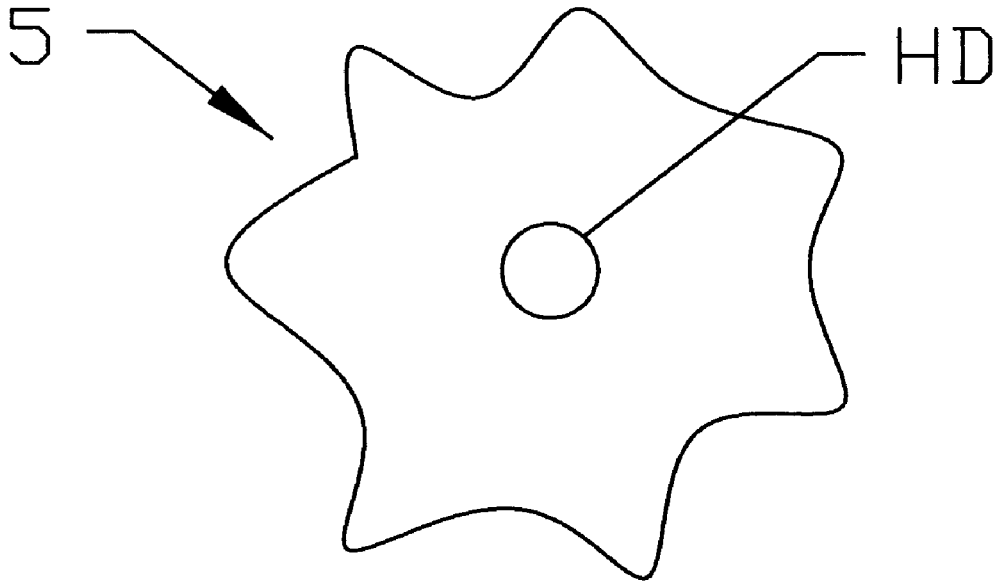
FIG. 4 shows a partial view of an assembly zone that includes a holding rod.

The beam 1 can also comprise, in its assembly zones 5, holding rods HD (see FIG. 4) that can be through rods, and whose function will be explained in the description of the manufacturing method.

It is clear that the number of crosspieces is adapted depending particularly on the desired length of the wooden beam 1 and on the load envisioned. Likewise, the setting angle $\alpha$ defined between the elongated members 2*a*, 2*b*, 2*c*, 2*d* and the crosspieces 3*a*, 3*b* can be adapted. Generally speaking, the increase in this setting angle $\alpha$ allows a decrease in the number of crosspieces and therefore in the cost of the wooden beam 1. The selection of the setting angle $\alpha$ therefore aims at finding a compromise between the cost of the wooden beam 1 and its desired performances. Generally speaking, the setting angle $\alpha$ can be comprised between 20 and 40°. As an example, a setting angle $\alpha$ of 30° seems to be an optimal compromise.

This wooden beam 1 is manufactured according to a specific manufacturing method comprising the following different steps.

Firstly, two basic elements forming two elongated members 2*a*, 2*c* are set in a model, in parallel and in the same direction. The distance separating the opposite surfaces of these elongated members 2*a*, 2*c* that are the furthest apart will determine the width of the wooden beam 1.

Secondly, basic elements forming the crosspieces 3*a*, 3*b* are set and glued, by way of the so-called flexible glue defined hereinabove, on the two first elongated members 2*a*, 2*c*, according to a predetermined pattern, for example, at an angle in a herringbone pattern along a predefined setting angle $\alpha$. The crosspieces 3*a*, 3*b* are set such that their ends do not extend past said elongated members 2*a*, 2*c* toward the exterior of said beam 1.

The arrangement of the basic elements at an angle in a herringbone pattern ensures an automatic crossbracing of the wooden beam 1. Additionally, the squaring of the wooden beam 1 is guaranteed and, consequently, imparts to the wooden beam 1 a good dimensional stability over time.

Thirdly, two other basic elements forming a third elongated member 2*b* and a fourth elongated member 2*d* are set and glued on the crosspieces 3*a*, 3*b* by way of the so-called flexible glue defined hereinabove, opposite the first elongated member 2*a* and the second elongated member 2*c*, respectively.

Fourthly, the wooden beam 1 thus formed is positioned in a press that is advantageously equipped with pressure cylinders. The press is activated, which tightens the structure or, more specifically, the assembly zones 5 comprising the contact zones 4. The layers of glue are crushed to a predetermined thickness and form elastic joints after drying, the thickness of these elastic joints being determined depending on the thickness "e" of the wooden beam 1 and its specification sheet. For instance, for a wooden beam 1 having an 8 m span, the elastic joints have an optimal value of 0.6 to 0.7 mm.

Fifthly and lastly, a nail or any other holding rod is nailed in each of the assembly zones 5 so as to affix the corresponding basic elements. This nail only fulfills the function of a clamp making it possible to displace the wooden beam 1 and to release the press without waiting for the glue to set. By limiting this waiting period, one thus increases the production rate and therefore the profitability of the manufacturing process.

This type of process is simple, quick, economical and ecological. It allows the manufacture of one-piece wooden beams 1 having very diverse dimensions, ranging from a small pinion beam to a so-called wide span wooden truss beam, whose length can reach 8 m, for example. The wooden beams 1 thus manufactured have a reduced weight and are therefore easier to manipulate than unitary wooden or wood core plywood beams.

By using a similar manufacturing method that uses a same press and the same basic wooden elements, it is possible for special applications, such as for underneath roof coverings, to make wooden beams 1 comprising crosspieces positioned perpendicular to the square rulers 2*a*, 2*b*, 2*c*, 2*d*.

Figure 2:
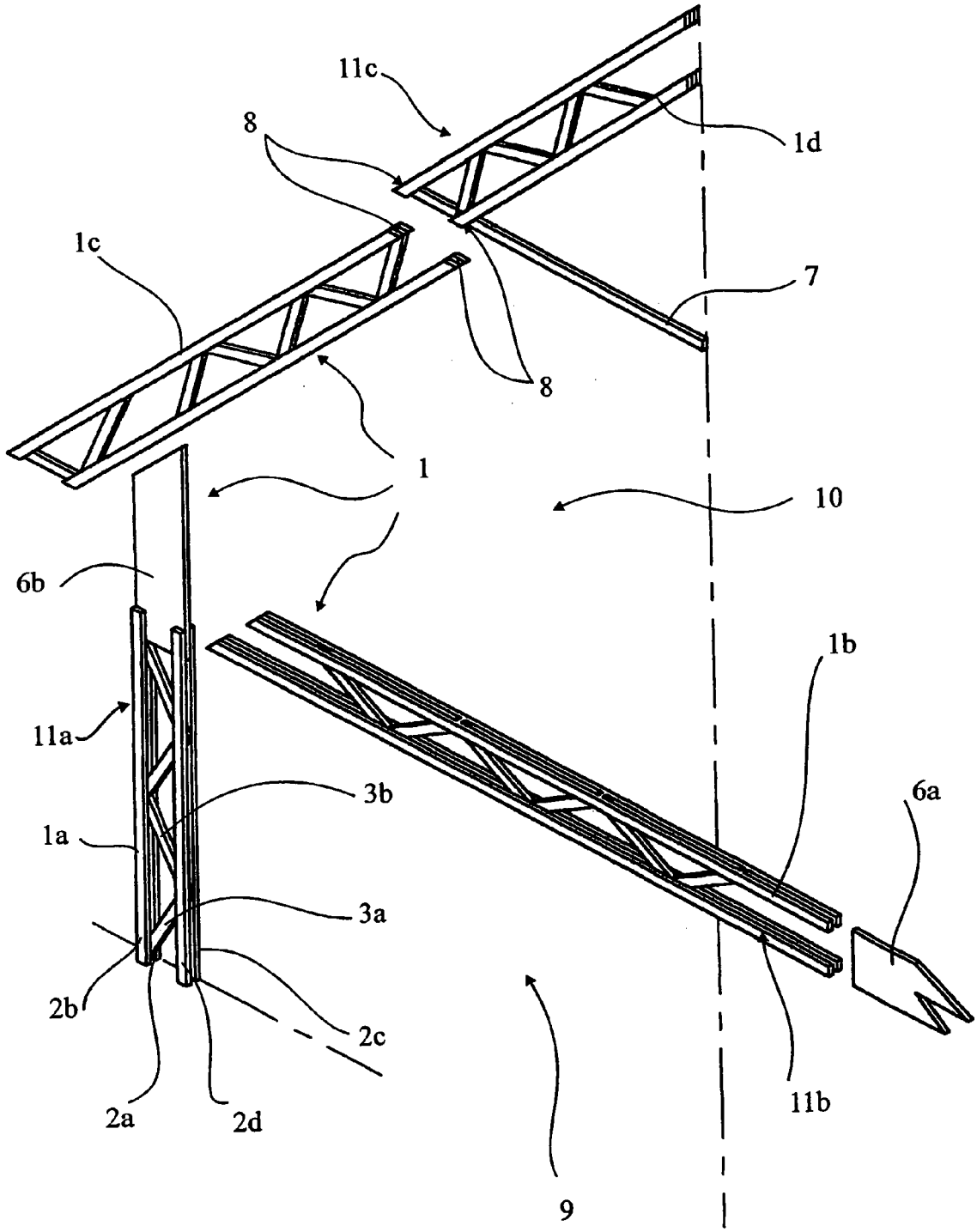
FIG. 2 is an exploded perspective view of a portion of a wooden frame made with wooden beams from FIG. 1.
Figure 3:
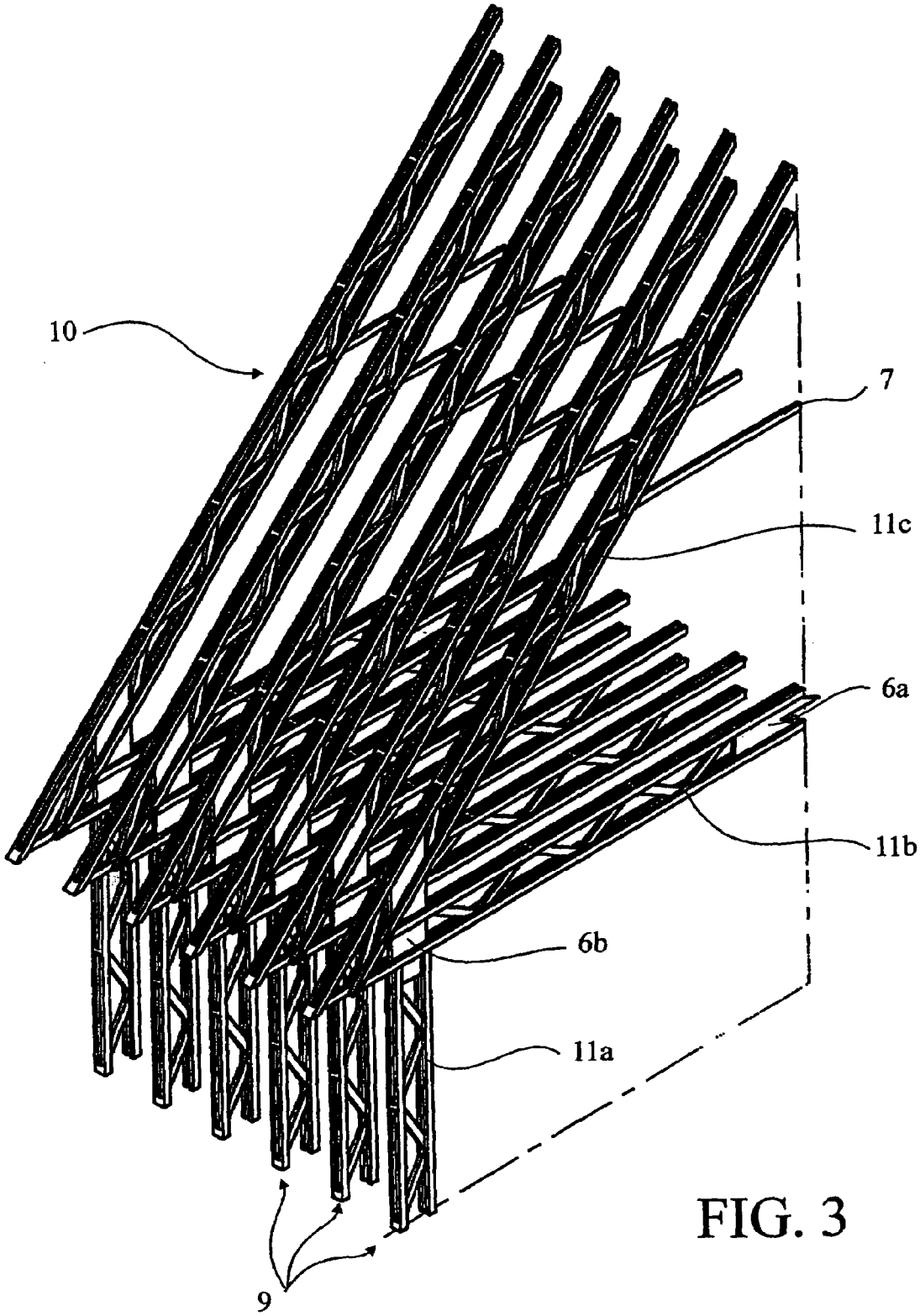
FIG. 3 is a partial perspective planar view of the wooden frame according to FIG. 2.

The use of the wooden beam 1 that is manufactured according to this method is described in reference to FIGS. 2 and 3.

FIG. 2 shows an example of assembling four wooden beams 1, numbered according to FIG. 1: 1*a*, 1*b*, 1*c*, 1*d*. In this example, the wooden beams 1*a*, 1*b*, 1*c*, 1*d* are used to form a post 11*a*, a tie beam 11*b* and a principal rafter 11*c*, lid. The tie beam 11*b* is formed by the wooden beam 1*b* and by another wooden beam that is not shown, the two wooden beams are horizontal and butt-assembled by way of a gusset 6*a*. Due to the use of the so-called flexible glue that imparts a better resistance to the wooden beams 1, the tie beam 11*b* can have a substantial span without requiring the use of an intermediary bearing wall. The principal rafter 11*c* is formed by the two wooden beams 1*c*, 1*d* that are butt-assembled by the horizontal spacer 7 that is nested in recesses 8 provided in the ends of the two beams 1*c* and 1*d*. In order to allow the junction of the tie beam 11*b*, of the post 11*a* and of the principal rafter 11*c*, the ends of the wooden beams 1*a*, 1*b*, 1*c* comprise zones without a crosspiece allowing for the passage of a gusset 6*b*. The assemblies of the wooden beams (1*a*, 1*b*, 1*c*, 1*d*) obtained in FIG. 2 by way of the gussets 6*a*, 6*b* and of the spacer 7 can also be obtained by way of other elements, such as cables, or screwed or nailed plates.

FIG. 3 gives an example of a wooden frame 10 made with the wooden beams 1 assembled according to FIG. 2 to form tie beams 11*b*, posts 11*a* and principal rafters 11*c*. This example clearly shows how the tie beams 11*b*, posts 11*a* and principal rafters 11*c* can be arranged to form frame "sections" 9 and allow a modular assembly of an entire structure forming the wooden frame 10 of a building without an inner bearing wall. Indeed, the frame sections 9 can be positioned side by side to build on request buildings having diverse lengths.

The so-called flexible glue imparts a good flexibility to these wooden frames 10, allowing the suppression of the grating and the creaking noise of the wood, the increase in the flexibility of the floor and, more generally speaking, the improvement of the living comfort while limiting the risk of fissures.

The wooden beams 1 constituting the wooden frames 10 define intervals that are used advantageously to receive service ducts that allow the passage of electrical cables or any type of conduits. The service ducts thus housed in the wooden frame 10 no longer pose an esthetical drawback and/or bulkiness. In a non-limiting manner, the wooden beams 1 can also be arranged to receive supports for the installation of housings for rolling shutters, mosquito nets and solar panels.

The present invention is not limited to the described example of embodiment but extends to any modification and alternative that are obvious to one skilled in the art, while remaining within the scope of the protection defined in the attached claims.

The invention claimed is:

1. A method of manufacturing a wooden beam comprising at least four elongated members connected by at least two crosspieces, said elongated members and said crosspieces being assembled to each other at assembly zones by gluing, the method comprising;

arranging first and second elongated members parallel to one another and at a predetermined distance from one another;

arranging the at least two crosspieces on the first and second elongated members;

gluing, with a flexible glue, contact zones of the at least two crosspieces to contact zones of the first and second elongated members;

arranging third and fourth elongated members respectively opposite the first and second elongated members and on the at least two crosspieces;

gluing, with a flexible glue, contact zones of the at least two crosspieces and contact zones of the first and second elongated members to contact zones of the third and fourth elongated members, whereby the first elongated member, the second elongated member, the third elongated member, the fourth elongated member, and the at least two crosspieces form an assembly; and pressing the assembly in order to crush layers of the flexible glue to a predetermined thickness, wherein elastic joints are formed in each assembly zone after the pressing and after the flexible glue is dry, and wherein the elastic joints allow for a relative movement between the first, second, third, and fourth elongated members and the at least two crosspieces.

2. The method of claim 1, wherein the flexible glue comprises a polyurethane flexible glue.

3. The method of claim 1, further comprising at least one holding rod positioned in at least one of the assembly zones.

4. The method of claim 1, wherein the first, second, third, and fourth elongated members and the at least two crosspieces have an identical cross-section.

5. The method of claim 1, wherein the at least two crosspieces are positioned at regular intervals and according to a predetermined pattern.

6. The method of claim 5, wherein the at least two crosspieces are oriented at an angle other than 90 degrees relative to the first, second, third and fourth elongated members.

7. The method of claim 6, wherein the angle is between 20 degrees and 40 degrees.

8. The method of claim 6, wherein the angle is 30 degrees.

9. The method of claim 1, wherein the at least two crosspieces are arranged to form a herringbone pattern.

10. A wooden beam made by the method of claim 1.

11. The wooden beam of claim 10, wherein the first, second, third, and fourth elongated members and the at least two crosspieces have one of:

a square-shaped cross-section; and a rectangular-shaped cross-section.

12. The wooden beam of claim 10, wherein at least one of the assembly zones is at least partially traversed by a holding rod.

13. A wooden frame for use in building construction, the wooden frame comprising a plurality of wooden beams according to claim 10 assembled to form at least one frame section.

14. The wooden frame of claim 13, wherein the at least one frame section comprises at least one post, at least one tie beam, at least one principal rafter.

15. A wooden frame for use in building construction, the wooden frame comprising at least two wooden beams according to claim 10 assembled to one another via at least one assembly element to form at least one frame section.

16. The wooden frame of claim 15, wherein the at least one assembly element comprises one of at least one gusset, at least one cable, at least one screwed plate, at least one nailed plate, and at least one spacer.

17. A modular wooden frame for use in building construction, the modular wooden frame comprising a plurality of wooden beams according to claim 10 assembled to one another to form a plurality of frame sections.

18. A wooden frame for use in building construction, the wooden frame comprising a plurality of wooden beams according to claim 10 assembled to one another via at least one assembly element to form at least one frame section, wherein the plurality of wooden beams are arranged to receive at least one of service ducts, supports for rolling shutter housings, mosquito nets, and solar panels.

19. A method of manufacturing a wooden beam which comprises first and second elongated members arranged parallel to one another and spaced at a predetermined distance from one another, third and fourth elongated members arranged respectively opposite the first and second elongated members, and a plurality of crosspieces having one end area connected to the first and third elongated members and another end area connected to the second and fourth elongated members, the method comprising:

arranging the first and second elongated members parallel to one another and spaced from one another by a predetermined distance;

arranging the third and fourth elongated members respectively opposite the first and second elongated members;

arranging the one end areas of the plurality of crosspieces between the first and third elongated members;

arranging the other end areas of the plurality of crosspieces between the second and fourth elongated members; and forming elastic joints by applying a flexible glue to contact zones of the plurality of crosspieces, to contact zones of the first and second elongated members, and to contact zones of the third and fourth elongated members, wherein, after the flexible glue is dry, the elastic joints allow for a relative movement between the first, second, third, and fourth elongated members and the plurality of crosspieces.

20. The method of claim 19, further comprising crushing layers of the flexible glue to a predetermined thickness.

21. A method of manufacturing a wooden beam comprising first and second elongated members spaced at a predetermined distance from one another, third and fourth elongated members arranged respectively opposite the first and second elongated members, and a plurality of crosspieces having one end portion connected to the first and third elongated members and another end portion connected to the second and fourth elongated members, the method comprising:

spacing the first and second elongated members apart from one another;

arranging the third and fourth elongated members respectively opposite the first and second elongated members;

applying a flexible glue to contact zones of the plurality of crosspieces, to contact zones of the first and second elongated members, and to contact zones of the third and fourth elongated members, and assembling the plurality of crosspieces, the first and second elongated members, and the third and fourth elongated members together to form the wooden beam, wherein, after the flexible glue is dry, elastic joints are formed in said contact zones and the elastic joints allow for a relative movement between the first, second, third, and fourth elongated members and the plurality of crosspieces.

22. The method of claim 21, further comprising, before the flexible glue is dry, crushing layers of the flexible glue to a predetermined thickness.

* * * * *